US005449278A

United States Patent [19]

Lin

[11] Patent Number: 5,449,278

[45] Date of Patent: Sep. 12, 1995

[54] DOUBLE ACTION PISTON HAVING PLURAL ANNULAR CHECK VALVES

[76] Inventor: Chi-So Lin, No. 13, Chin Nan Lane, Pei Tung District, Taichung City, Taiwan

[21] Appl. No.: 340,328

[22] Filed: Nov. 14, 1994

[51] Int. Cl.[6] ..... F04B 39/10

[52] U.S. Cl. ..... 417/526; 417/527; 417/547; 417/553; 417/566

[58] Field of Search ..... 417/525, 526, 527, 547, 417/550, 553, 566; 137/860

[56] References Cited

U.S. PATENT DOCUMENTS

| | | | |
|---|---|---|---|
| 130,642 | 8/1872 | Hussey | 417/526 |
| 2,683,060 | 7/1954 | Wise et al. | 417/547 |
| 3,981,625 | 9/1976 | Wickenberg | 417/526 |
| 5,051,073 | 9/1991 | Newbold | 417/526 |

FOREIGN PATENT DOCUMENTS

| | | | |
|---|---|---|---|
| 1165271 | 1/1957 | France | 137/860 |
| 696168 | 8/1953 | United Kingdom | 417/526 |

*Primary Examiner*—Timothy S. Thorpe
*Assistant Examiner*—Roland G. McAndrews, Jr.
*Attorney, Agent, or Firm*—Browdy and Neimark

[57] ABSTRACT

An air pump piston is provided peripherally with a first leakproof ring and a second leakproof ring, which are located respectively and contiguously at both ends of the piston. Located peripherally between the first and the second leakproof rings is a radially disposed air hole. The piston is fastened at the second end thereof with a piston rod such that the air hole of the piston is in communication with an axial passageway of the piston rod. The piston is further provided peripherally between the first leakproof ring and the air hole with at least one first duct disposed radially. The piston is still further provided peripherally with at least one second duct which is disposed radially and located between the second leakproof ring and the air hole. The piston is provided at the first end thereof with an air admitting hole in communication with the first duct. The piston is provided at the second end thereof with an air duct in communication with the second duct. First and the second leakproof elements are fitted over the piston such that the first and the second ducts are sealed off respectively by the first and the second leakproof rings.

2 Claims, 2 Drawing Sheets

DOUBLE ACTION PISTON HAVING PLURAL ANNULAR CHECK VALVES

FIELD OF THE INVENTION

The present invention relates generally to an air pump, and more particularly to an air pump piston capable of doing a dual-directional pumping of air.

BACKGROUND OF THE INVENTION

There are a variety of conventional air pump pistons capable of inflating an object in a dual-directional manner. The air pump piston disclosed in the U.S. Pat. No. 5,051,073 is a case in point. These conventional air pump pistons are generally different in construction from one another and are similar in operating principle. The air pump piston of the prior art is fitted snugly into an air pump cylinder such that the cylinder is divided into two compression chambers. The piston is forced back and forth within the cylinder such that the air in the first compression chamber is compressed by the piston in a forward stroke, and that the air in the second compression chamber is compressed by the piston in a return stroke. The compressed air in the first and the second compression chambers is guided respectively into a hollow piston rod via the radially disposed air holes of the piston before the compressed air is transmitted to the air pump head through which the compressed air is forced into a tire via the inflation valve of the tire, which is engaged with the air pump head.

SUMMARY OF THE INVENTION

It is therefore the primary objective of the present invention to provide an air pump piston with a novel means capable of pumping air into an object in a dual-directional manner.

The foregoing objective of the present invention is attained by an air pump piston provided peripherally with a first leakproof ring and a second leakproof ring, which are located respectively and contiguously at both ends of the piston. Located peripherally between the first and the second leakproof rings is a radially disposed air hole. The piston is fastened at the second end thereof with a piston rod such that the air hole of the piston is in communication with an axial passageway of the piston rod. The piston is further provided peripherally between the first leakproof ring and the air hole with at least one first duct disposed radially. In addition, the piston is still further provided peripherally between the second leakproof ring and the air hole with at least one second duct disposed radially. The piston is provided at the first end thereof with an air admitting hole in communication with the first duct. The piston is further provided at the second end thereof with an air duct in communication with the second duct. The first and the second leakproof rings are fitted over the piston such that the first duct and the second duct are sealed off respectively by the first and the second leakproof rings.

DETAILED DESCRIPTION OF THE INVENTION

Figure 1:
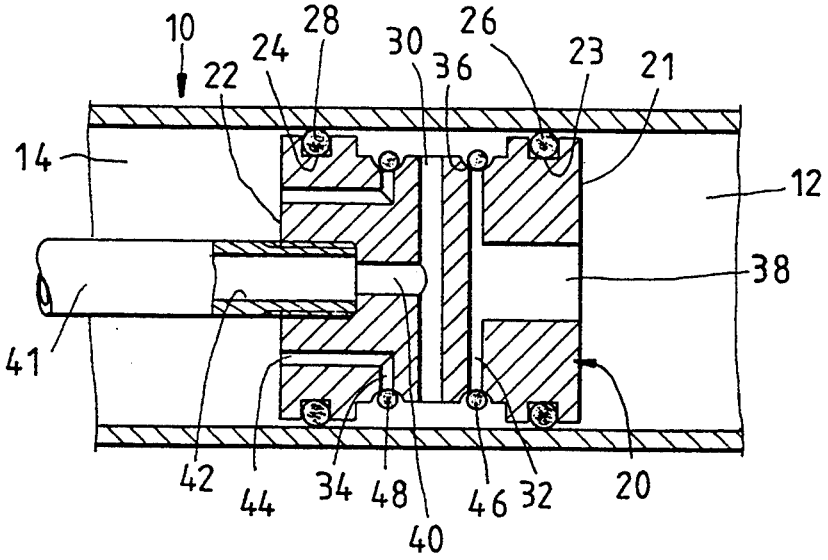
FIG. 1 shows a sectional view of a first preferred embodiment of the present invention.

As shown in FIG. 1, an air pump piston 20 of the first preferred embodiment of the present invention is provided peripherally with two circular slots 23 and 24 which are located respectively and contiguously at a first end surface 21 thereof and a second end surface 22 thereof, and which are intended for use in receiving therein respectively a first leakproof ring 26 and a second leakproof ring 28. The piston 20 is further provided peripherally with an air hole 30 which is disposed radially between the two circular slots 23 and 24. The piston 20 is still further provided peripherally with at least one first duct 32 which is disposed radially between the air hole 30 and the first circular slot 23. It must be noted here that a plurality of first ducts 32 may be disposed equidistantly in the periphery of the piston 20. The piston 20 is still further provided peripherally with at least one second duct 34 which is disposed radially between the air hole 30 and the second circular slot 24. A plurality of second ducts 34 may be disposed equidistantly in the periphery of the piston 20. The first duct 32 and the second duct 34 are provided respectively with a recess 36. The first end surface 21 of the piston 20 is provided along the direction of the axis of the piston 20 with at least one air admitting hole 38 in communication with the first duct 32. The second end surface 22 of the piston 20 is provided with an air guiding hole 40 in communication with the air hole 30. The air guiding hole 40 is intended to fasten one end of a piston rod 41 such that the air hole 30 is in communication with a passageway 42 of the piston rod 41. The second end surface 22 of the piston 20 is provided along the direction of the axis of the piston 20 with at least one channel 44 communicating with the second duct 34. A first leakproof element 46 and a second leakproof element 48 are disposed in semi-circular recesses on the periphery of the piston 20 such that the first and the second ducts 32 and 34 of the piston 20 are sealed off respectively by the first and the second leakproof elements 46 and 48.

The piston 20 is fitted snugly into an air pump cylinder 10 such that the cylinder 10 is divided into a first compression chamber 12 and a second compression chamber 14, and that the first and the second leakproof rings 26 and 28 are engaged airtightly with the inner wall surface of the cylinder 10, and further that the first and the second leakproof elements 46 and 48 are not substantially in contact with the inner wall surface of the cylinder 10. The piston rod 41 is fastened at one end thereof with an inflation valve connection head of the air pump.

Figure 2:
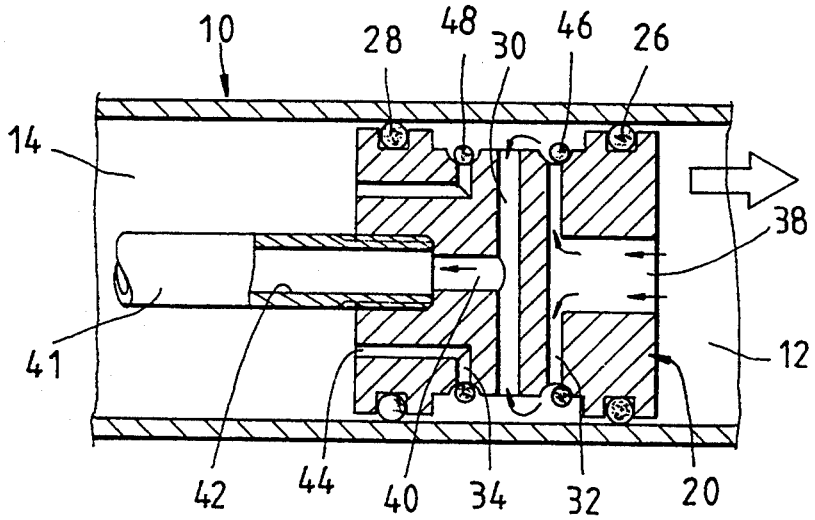
FIGS. 2 and 3 show schematic views of the first preferred embodiment at work according to the present invention.

In operation, the piston 20 is forced to move back and forth within the cylinder 10 such that the air in the first compression chamber 12 is compressed by the piston 20. The compressed air in the first compression chamber 12 is forced to flow toward the first duct 32 via the air admitting hole 38 in view of the fact that the cylinder wall is sealed off by the first leakproof ring 26. The first leakproof element 46 is then caused to displace slightly by the compressed air to permit the compressed air to flow through the first duct 32 which was originally sealed off by the first leakproof element 46. The compressed air is then allowed to flow into the air hole 30 via the first duct 32 in view of the fact that the cylinder 10 is sealed off by the two leakproof rings 26 and 28, and that the second duct 34 is sealed off by the second leakproof element 48 so as to prevent the compressed air from flowing into the second compression chamber 14 via the second duct 34. The compressed air is finally guided via the air hole 30 to flow into the passageway 42 of the piston rod 41. As a result, the compressed air is injected into a tire via the air pump connection head which is engaged with the inflation valve of the tire, as shown in FIG. 2.

Figure 3:
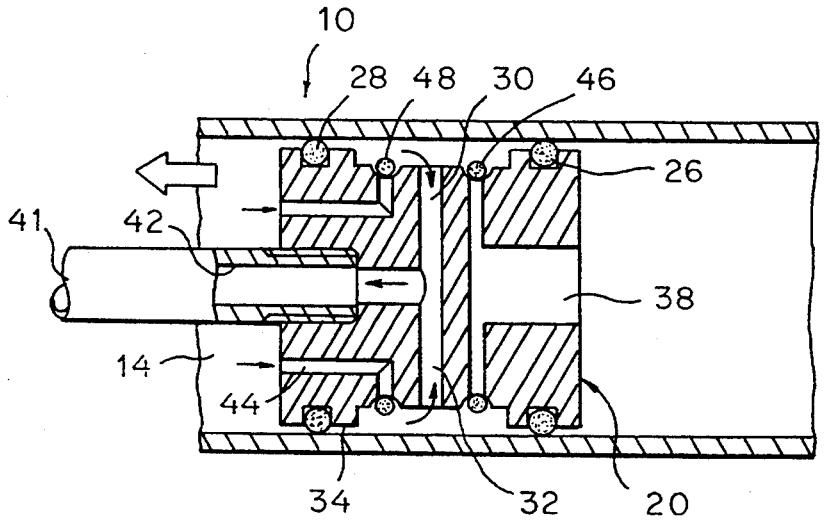

As the piston 20 is in operation, the air in the second compression chamber 14 is compressed. In the meantime, the cylinder 10 is sealed off by the second leakproof ring 28. The compressed air in second compression chamber 14 is permitted to flow into the second duct 34 via the channel 44. As a result, the second leakproof element 48 is forced by the compressed air to displace so as to permit the compressed air to flow into the air hole 30 via the second duct 34. The compressed air of the second compression chamber 14 is finally injected into the tire via the passageway 42 of the piston rod 41 and the air pump connection head engaging the inflation valve of the tire. It must be noted here that the first duct 32 is sealed off by the first leakproof element 46 and that the cylinder 10 is sealed off by the two leakproof rings 26 and 28 when the compressed air is permitted to flow into the air hole 30 via the second duct 34, as shown in FIG. 3.

As the air in the first compression chamber 12 is compressed, the air pressure of the second compression chamber 14 is smaller than the atmospheric pressure. As a result, the second compression chamber 14 is replenished with the atmospheric air. On the other hand, when the air of the second compression chamber 14 is compressed, the first compression chamber 12 is replenished with the atmospheric air.

The piston 20 of the present invention is capable of preventing the air leakage of a tire when the connection head of the air pump is engaged with the inflation valve of the tire in view of the fact that the air pressure of the passageway 42 of the piston rod 41 is transmitted to the air hole 30, and that the cylinder 10 is sealed off by the two leakproof rings 26 and 28, and further that the first duct 32 and the second duct 34 are sealed off by the two leakproof elements 46 and 48, as shown in FIG. 1.

Figure 4:
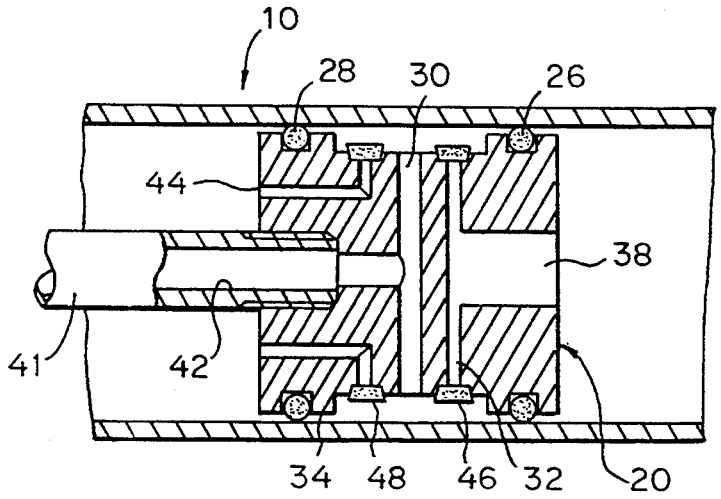
FIG. 4 shows a sectional view of a second preferred embodiment of the present invention.

The second preferred embodiment of the present invention is shown in FIG. 4 and is different from the first preferred embodiment in that the former is provided with the two leakproof elements 46 and 48 which have a rectangular cross section in contrast to a round cross section of the latter.

What is claimed is:

1. An air pump piston for reciprocating along on axis comprising peripherally a first leakproof ring and a second leakproof ring, which are located respectively proximate a first end surface of said piston and a second end surface of said piston, said piston further comprising peripherally a radially disposed air hole located between said first leakproof ring and said second leakproof ring, said piston provided in said second end surface with an air guiding hole in communication with said air hole, said air guiding hole for use in fastening said piston with a piston rod such that said air hole of said piston is in communication with an axially disposed passageway of said piston rod; wherein said piston is provided peripherally with at least one radially disposed first duct located between said air hole and said first leakproof ring, said piston further provided peripherally with at least one radially disposed second duct located between said air hole and said second leakproof ring; wherein said piston includes with an air admitting hole in said first end surface extending along the direction of said axis of said piston and communicating with said first duct; wherein said piston includes surface with an air duct in said second end surface extending along the direction of said axis of said piston and communicating with said second duct; and wherein said piston is provided peripherally with a first leakproof element and a second leakproof element, which are intended to seal off respectively said first duct and said second duct.

2. The air pump piston according to claim 1 wherein said first duct and said second duct are provided respectively with a semi-circular recess.

* * * * *